US007867314B2

(12) United States Patent
Ono et al.

(10) Patent No.: US 7,867,314 B2
(45) Date of Patent: Jan. 11, 2011

(54) IRON-BASED POWDER FOR POWDER METALLURGY

(75) Inventors: Tomoshige Ono, Chiba (JP); Shigeru Unami, Chiba (JP); Takashi Kawano, Chiba (JP); Yukiko Ozaki, Chiba (JP); Kyoko Fujimoto, Kawasaki (JP)

(73) Assignee: JFE Steel Corporation, Tokyo (JP)

( * ) Notice: Subject to any disclaimer, the term of this patent is extended or adjusted under 35 U.S.C. 154(b) by 0 days.

(21) Appl. No.: 12/733,560

(22) PCT Filed: Sep. 9, 2008

(86) PCT No.: PCT/JP2008/066615

§ 371 (c)(1),
(2), (4) Date: May 19, 2010

(87) PCT Pub. No.: WO2009/035119

PCT Pub. Date: Mar. 19, 2009

(65) Prior Publication Data

US 2010/0224025 A1 Sep. 9, 2010

(30) Foreign Application Priority Data

Sep. 14, 2007 (JP) ..... 2007-239570
May 12, 2008 (JP) ..... 2008-124277
Jul. 31, 2008 (JP) ..... 2008-198306

(51) Int. Cl.
*B22F 1/02* (2006.01)

(52) U.S. Cl. ..... 75/252; 419/35

(58) Field of Classification Search ..... 75/252
See application file for complete search history.

(56) References Cited

U.S. PATENT DOCUMENTS

| | | | | |
|---|---|---|---|---|
| 3,357,818 | A | 12/1967 | Findeisen | |
| 5,782,954 | A | 7/1998 | Luk | |
| 6,451,082 | B1 | 9/2002 | Ozaki et al. | |
| 2003/0219617 | A1 | 11/2003 | Ozaki et al. | |
| 2004/0038067 | A1 | 2/2004 | Ozaki et al. | |
| 2006/0000310 | A1 * | 1/2006 | Solimnjad | 75/252 |

FOREIGN PATENT DOCUMENTS

| | | |
|---|---|---|
| CA | 2 307 109 | 4/1999 |
| CA | 2 632 460 | 7/2007 |
| JP | A 1-219101 | 9/1989 |
| JP | A-1-219101 | 9/1989 |

(Continued)

OTHER PUBLICATIONS

International Search Report issued for International Application No. PCT/JP2008/066615 on Dec. 16, 2008.

(Continued)

*Primary Examiner*—Roy King
*Assistant Examiner*—Ngoclan T Mai
(74) *Attorney, Agent, or Firm*—Oliff & Berridge, PLC

(57) ABSTRACT

Flowability-improving particles containing 50 to 100% by mass of carbon black are adhered to surfaces of iron powder through a binder to provide an iron-based powder for powder metallurgy which has excellent flowability and which is capable of uniformly filling a thin-walled cavity, compaction with high ejection force, and maintaining sufficient strength of a sintered body in subsequent sintering.

12 Claims, 1 Drawing Sheet

FOREIGN PATENT DOCUMENTS

| | | | |
|---|---|---|---|
| JP | A 2-217403 | | 8/1990 |
| JP | A 3-162502 | | 7/1991 |
| JP | A 5-148505 | | 6/1993 |
| JP | A-7-157838 | | 6/1995 |
| JP | A 2001-254102 | | 9/2001 |
| JP | A 2002-515542 | | 5/2002 |
| JP | A 2002-180103 | | 6/2002 |
| JP | A 2004-232079 | | 8/2004 |
| JP | A-2004-232079 | | 8/2004 |
| JP | A 2005-232592 | | 9/2005 |
| JP | A-2006-4530 | | 1/2006 |
| JP | A 2007-77468 | | 3/2007 |
| JP | A-2007-077468 | | 3/2007 |
| JP | A-2007-517980 | | 7/2007 |
| WO | WO 99/20689 | | 4/1999 |
| WO | WO 01/17716 | A1 | 3/2001 |
| WO | WO 2006/004530 | A1 | 1/2006 |
| WO | WO 2007/078228 | A1 | 7/2007 |

OTHER PUBLICATIONS

May 14, 2009 Office Action issued in Japanese Patent Application No. 2008-234406 (with translation).

Jul. 20, 2010 Canadian Office Action issued in Canadian Patent Application No. 2,699,033.

* cited by examiner

IRON-BASED POWDER FOR POWDER METALLURGY

TECHNICAL FIELD

The present invention relates to an iron-based powder suitable for use in powder metallurgy.

BACKGROUND ART

Powder metallurgical technology is capable of producing machine parts having complicated shapes with high dimensional precision and is thus capable of significantly decreasing the production costs of the machine parts. Therefore, various machine parts produced by applying the powder metallurgical technology are used in many fields. Further, in recent years, the requirement for miniaturization or weight lightening of machine parts has increased, and various raw material powders for powder metallurgy for producing small and lightweight machine parts having sufficient strength have been investigated.

For example, Japanese Unexamined Patent Application Publication No. 1-219101 (Patent Document 1), Japanese Unexamined Patent Application Publication No. 2-217403 (Patent Document 2), Japanese Unexamined Patent Application Publication No. 3-162502 (Patent Document 3), and Japanese Unexamined Patent Application Publication No. 5-148505 (Patent Document 4) disclose raw material powders for powder metallurgy produced by adhering an alloying powder to surfaces of a pure iron powder or alloy steel powder with a binder (referred to as "segregation-free treatment"). Such powders mainly composed of iron (in a narrow sense, referred to as an "iron-based powder" hereinafter) are usually produced by adding an additive powder (e.g., a copper powder, a graphite powder, an iron phosphide powder, a manganese sulfide powder, or the like) and a lubricant (e.g., zinc stearate, aluminum stearate, or the like) and the resultant mixed powders (also referred to as "iron-based powders" in a broad sense) are supplied to production of machine parts. Hereinafter, the iron-based powder has a broad sense unless otherwise specified.

However, the iron-based powder (narrow sense), the additive powder, and the lubricant have different characteristics (i.e., the shape, particle size, and the like), and thus flowability of a mixed powder is not uniform. Therefore, the following problems occur:

(a) The iron-based powder (narrow sense), the additive powder, the lubricant, and the like locally unevenly distribute due to the influence of vibration or dropping during transport of the mixed powder to a storage hopper. The deviation due to differences in flowability cannot be completely prevented even by the segregation-free treatment.

(b) Since relatively large spaces are produced between particles of the mixed powder charged in the hopper, the apparent density of the mixed powder decreases.

(c) The apparent density of the mixed powder depositing in a lower portion of the hopper increases over time (i.e., due to the influence of gravitation), while the mixed powder in an upper portion of the hopper is stored at a low apparent density. Therefore, the apparent density of the mixed powder is non-uniform in the upper and lower portions of the hopper.

It is difficult to mass-produce machine parts having uniform strength using such a mixed powder.

In order to solve the above problems (a) to (c), it is necessary to increase flowability of the mixed powder of the iron-based powder (in a narrow sense), the additive powder, and the lubricant.

Therefore, Japanese Unexamined Patent Application Publication No. 2002-180103 (Patent Document 5) discloses an iron-based powder mainly composed of an iron powder having a predetermined range of particle diameters. However, this technique not only decreases the yield of the iron powder because an iron powder out of the specified range cannot be used but also causes difficulty in uniformly and sufficiently filling thin-walled cavities, such as a gear edge or the like, with the ion-based powder.

In addition, Japanese Unexamined Patent Application Publication (Translation of PCT Application) No. 2002-515542 (Patent Document 6) discloses a technique for improving flowability of an iron powder in warm compaction by adding a small amount of inorganic particulate oxide (e.g., 0.005 to 2% by mass of $SiO_2$ having a particle diameter of less than 40 nm) having a particle diameter of less than 500 nm (nanometer). However, in this technique, an oxide such as $SiO_2$ remains in sintering and inhibits bonding between iron powder particles, thereby decreasing strength of the resultant sintered body.

Further, PCT International Publication No. WO06/004530 A1 (Patent Document 7) discloses a powder metallurgical composition containing an iron powder or an iron-based metal powder, a lubricant and/or a binder, and carbon black as a flowability increasing agent, the amount of the carbon black being 0.001 to 0.2% by weight. This technique is deemed to be not associated with deterioration of quality of sintered parts.

As the iron powder or alloy steel powder used as a raw material of the iron-based powder, there are an atomized iron powder, a reduced iron powder, and the like according to the production methods. Here, a pure iron powder may be referred to as an iron powder, but the term "iron powder" in the classification by production methods is used in a broad sense including an alloy steel powder. Hereinafter, the term "iron powder" represents an iron powder in the broad sense. The alloy steel powder includes steel powders other than prealloys, i.e., a partially alloyed steel powder and a hybrid alloyed steel powder.

DISCLOSURE OF INVENTION

Problem to be Solved by the Invention

However, when machine parts having thin-walled portions are mass-produced by the technique of Patent Document 7, variation occurs in the filling rate, and thus the problems are not sufficiently resolved.

The present invention aims at solving the above-mentioned problems. Namely, an object of the invention is to provide an iron-based powder for powder metallurgy which is excellent in flowability and capable of uniformly filling a thin-walled cavity without variation, exhibiting low ejection force of a compacted body, and maintaining sufficient strength of a sintered body during subsequent sintering.

Means for Solving the Problem

The present invention is as follows.

(1) An iron-based powder for powder metallurgy including iron powder particles with surfaces to each of which flowability-improving particles containing 50 to 100% by mass of carbon black adhere through a binder.

The iron powder is an iron powder in the broad sense including an alloy steel powder. The binder may adhere at least a portion of an additive powder (particularly, an alloying powder) to the iron powder.

(2) The iron-based powder for powder metallurgy described above in (1), wherein the binder adheres to a portion of the surface of each of the iron powder particles, and the flowability-improving particles adhere to at least a portion of the surface of the binder.

That is, in the present invention, preferably, the surfaces of the iron powder are coated with the binder, and then the flowability-improving particles are adhered to the surface of the binder, and the iron powder particles are partially, not entirely, coated with the binder.

(3) The iron-based powder for powder metallurgy described above in (1) or (2), wherein the coverage of the iron powder with the binder is 50% or less.

(4) The iron-based powder for powder metallurgy described above in any one of (1) to (3), wherein the coverage of the iron powder with the binder is 10% or more and 50% or less.

The coverage of the iron powder with the binder is more preferably 30% to 50%.

The coverage described above in (2) and (3) represents the ratio of the area coated with the binder to the surface area of the iron powder particles.

(5) The iron-based powder for powder metallurgy described above in any one of (1) to (4), wherein the coverage of the binder with the flowability-improving particles is 50% or more.

The coverage with the flowability-improving particles adhering to the surface of the binder represents the ratio of the area coated with the flowability-improving particles to the surface area of the iron powder particles coated with the binder.

(6) The iron-based powder for powder metallurgy described above in any one of (1) to (5), wherein the penetration of the binder is 0.05 to 2 mm.

The penetration is preferably 0.05 to 1 mm.

(7) The iron-based powder for powder metallurgy described above in any one of (1) to (6), wherein the binder is at least one of zinc stearate, lithium stearate, calcium stearate, stearic acid monoamide, and ethylenebis(stearamide).

(8) The iron-based powder for powder metallurgy described above in any one of (1) to (7), wherein the iron-based powder contains as an alloy component at least one selected from Cu, C, Ni, and Mo.

The iron powder preferably contains as an alloy component at least one selected from Cu, C, Ni, and Mo.

(9) The iron-based powder for powder metallurgy described above in any one of (1) to (8), wherein the iron powder is at least one selected from an atomized iron powder, a reduced iron powder, and an iron powder to which an alloy component is partially diffusion bonded.

The alloy component is preferably selected from those described above in (8).

(10) The iron-based powder for powder metallurgy described above in any one of (1) to (9), wherein the iron powder contains less than 50% by mass of iron powder not having the binder on the surfaces thereof.

For example, when a first iron powder is subjected to segregation-free treatment and then mixed with a second iron powder not subjected to segregation-free treatment, the second iron powder corresponds to an iron powder not having the binder.

In the invention (10), the coverage of the iron powder with the binder is an average coverage including the iron powder not having the binder.

(11) The iron-based powder for powder metallurgy described above in any one of (1) to (10), wherein the flowability-improving particles contain, in addition to the carbon black, at least one of powders of $Al_2O_3.MgO.2SiO_2.xH_2O$, $SiO_2$, $TiO_2$, and $Fe_2O_3$, and the average particle diameter of the flowability-improving particles is in a range of 5 to 500 nm.

(12) The iron-based powder for powder metallurgy described above in any one of (1) to (11), wherein the flowability-improving particles contain, in addition to the carbon black, a PMMA powder and/or a PE powder, and the average particle diameter of the flowability-improving particles is in a range of 5 to 500 nm.

Both the flowability-improving particles described above in (11) and the flowability-improving particles described above in (12) may be added.

(13) The iron-based powder for powder metallurgy described above in any one of (1) to (12), wherein the flowability-improving particles are contained at a ratio of 0.01 to 0.3°parts by mass relative to 100 parts by mass of the iron powder.

REFERENCE NUMERALS

Figure 1:
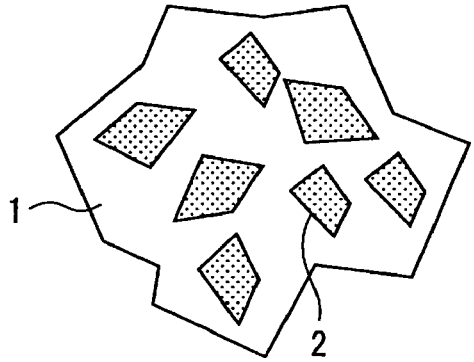
FIG. 1 is an explanatory view schematically showing a state in which a binder, graphite, and carbon black adhere and partially coat an iron powder.

1 iron powder particles
2 portion coated with a binder, graphite, and carbon black
3 carbon black particles
4 filling shoe
5 iron-based powder

BEST MODE FOR CARRYING OUT THE INVENTION

A preferred embodiment of the present invention is described. Except for a portion concerning mixing of flowability-improving particles, known powders for powder metallurgy (including selection of raw materials and additives) and production methods therefor (including procedures and apparatuses) (disclosed in, for example, Japanese Unexamined Patent Application Publication No. 2005-232592, etc) can be applied.

(Method of Producing Iron-Based Powder)

In the present invention, an iron powder and an alloy component are mixed together with a binder under heating using a mixer (a type of segregation-free treatment). Flowability-improving particles containing 50 to 100% by mass of carbon black are added after the segregation-free treatment and are mixed in a dry state with a mixer.

Here, various characteristic improving agents such as a machinability improving agent and the like may be added together with the alloy component and may be mixed under heating together with the binder. The alloy component and the characteristic improving agents are generally powders of about 1 to 20 μm. The alloy component is typically a graphite powder, a Cu powder, or a Ni powder, and a Cr powder, a W powder, a Mo powder, a Co powder, or the like is also frequently used. The cutting ability improving agent is typically a MnS powder or a $CaF_2$ powder, and a phosphate powder, a BN powder, or the like is also used. In addition, a lubricant having a higher melting point than the heating temperature may be added at the same time as the alloy component.

Further, after the segregation-free treatment, a powder lubricant is preferably added for securing compactibility (referred to as a "free lubricant"). Each lubricant can be appropriately selected from known lubricants. The flowability-improving particles are preferably added and mixed with the iron powder (iron-based powder) after the segregation-free treatment at the same time as the free lubricant. Another characteristic improving agent is a slidability-improving agent.

As the mixer, a high-speed mixer which is a mechanical mixing-type mixer is preferred from the viewpoint of mixing force. However, the mixer may be appropriately selected according to the production amount of the iron-based powder, desired flowability, and the like.

Preferred specific procedures include charging a predetermined amount of iron powder in a high-speed mixer, and adding the alloy component such as a graphite powder, a Cu powder, or the like and the binder. After these raw materials are charged, heating and mixing is started. The rotational speed of a rotating impeller in the high-speed mixer depends on the size of a mixing tank, and the shape of the rotating impeller, but is generally preferably about 1 to 10 m/sec in terms of the peripheral speed at the tip of the rotating impeller. Heating and mixing is performed until the temperature in the mixing tank is the melting point of the binder or higher, and mixing is performed at a temperature of the melting point or higher for, preferably, about 1 to 30 minutes. After the raw materials are sufficiently mixed, the mixing tank is cooled. When the binder is solidified in the cooling step, additives such as the alloy component and the like are adhered to the surfaces of the iron powder.

In addition, after the binder is completely solidified, the free lubricant is added. The lubricant used is a lubricant added for improving ejection property during compaction. The free lubricant can be appropriately selected from known lubricants, but metallic soap, amide wax, polyamide, polyethylene, polyethylene oxide, or the like is preferably used. Specifically, zinc stearate, lithium stearate, calcium stearate, stearic acid monoamide, ethylenebis(stearamide), and the like are preferred. The particle diameter of the free lubricant is preferably about 1 to 150 μm.

The free lubricant is added after the binder is solidified and is thus in a free state without adhering to the iron powder particles. Therefore, the term "free lubricant" is used.

The flowability-improving particles containing carbon black as a main component are added at the same time as addition of the free lubricant. At this time, the binder is completely solidified, but the flowability-improving particles adhere to the iron powder particles due to Van der Waals force and electrostatic force because the flowability-improving particles are very fine (i.e., particle diameter of 5 to 500 nm). The flowability-improving particles are described later.

The iron-based powder of the present invention is produced by the above-described method.

(Coating with Binder)

The binder may be appropriately selected from known binders, and any one of a heat melting type and a heat solidification type can be used. In particular, a binder having lubricity after solidification is preferred. The reason for this is that this type decreases frictional force between powder particles, improves flowability of a powder, and promoting rearrangement of particles at an early stage of compaction. Specifically, metallic soap, amide wax, polyamide, polyethylene, polyethylene oxide, or the like is used. In particular, zinc stearate, lithium stearate, calcium stearate, stearic acid monoamide, and ethylenebis(stearamide) are preferred. These binders may be used alone or in a mixture of two or more.

Considering flowability of the iron powder coated with the binder, adhesive force between the binder and the binder is larger than adhesive force between the iron powder and the iron powder and adhesive force between the iron powder and the binder. Therefore, when the surfaces of the iron powder are entirely coated with the binder, the flowability significantly deteriorates. In view of the flowability, the binder is preferably localized on the surfaces of the iron powder. In the present invention, therefore, it is a preferred requirement that the binder is adhered to only portions of the surfaces of the iron powder.

The preferred coverage of the iron powder surfaces with the binder depends on the addition ratios of the binder, graphite, and the like, but is preferably 50% or less and more preferably 10% to 50%. When the coverage exceeds 50%, adhesive force between the iron powder particles is increased, thereby degrading flowability. On the other hand, when the coverage is less than 10%, the graphite powder and the like may not be sufficiently adhered to the surfaces of the iron powder depending on the addition ratios of graphite and the like. In this case, when the ratio of fine particles is increased, flowability rather deteriorates. The coverage is further preferably 30% to 50%.

The coverage can be easily controlled by the addition amount of the binder. Also, the coverage can be adjusted by controlling the mixing conditions such as the mixing temperature, the mixing speed, and the like. The amount of the binder added is preferably adjusted within a range of about 0.05 to 0.8 parts by mass relative to 100 parts by mass of the iron powder and also according to a desired coverage.

Here, the coverage with the binder is represented by the ratio (%) of the total area of portions coated with the binder to the total surface area of the iron powder particles within an observation range. That is, for example, when one particle of the iron powder including graphite as an alloy element and carbon black particles as the flowability-improving particles is observed with SEM, as shown in FIG. 1, an iron powder particle 1 has portions 2 coated with a binder adhering to the surface (including a case in which graphite (not shown) or carbon black (not shown) further adhere to the binder). The coverage of the iron powder particle 1 is the area ratio (%) of the portions 2.

In the SEM observation, it is very difficult to discriminate the binder adhering to the iron powder surface under general-purpose observation conditions used for usual observation (for example, acceleration voltage 15 kV, shape-enhanced image). Namely, under these conditions, the presence of the binder on the iron powder surface is recognized, but image analysis using differences in color tone cannot be performed.

Therefore, as a result of various investigations, the inventors found that a difference between the iron powder and the binder is made very clear by a shape-enhanced image at an acceleration voltage of 5 kV or less, more preferably 3 kV or less.

That is, the acceleration voltage' required for determining the ratio of the binder adhering to the iron powder surface is 0.1 to 5 kV and more preferably in a range of 1 to 3 kV. In this case, clear contrast can be obtained for discriminating between the iron powder and the binder. The detector used may be either a secondary electron detector which produces a shape-enhanced image or an in-lens detector which produces a material-enhanced image, but the secondary electron detector is more preferably used.

The image photographed under the optimized measurement conditions is input as digital data in a personal computer. The data is binarized with an image analysis software, and then the area ratio (%) of the binder adhering to the iron powder surface is determined as a coverage with the binder adhering to the iron powder surface. In the SEM observation for calculating the coverage, preferably about 10 fields of view are observed with a magnification of 300 times, and an average is determined.

The penetration (hardness) of the binder used is 0.05 mm or more and 2 mm or less, preferably 0.05 mm or more and 1 mm or less. The penetration is measured by a method for measuring hardness of wax and asphalt as described in JIS K-2207 and usually at a room temperature of 25° C. Although the measurement is preferably performed for the binder after the segregation-free treatment, the measurement is performed for a simple binder in a bulk state (pellet state) after heat treatment corresponding to the segregation-free treatment according to demand because it is difficult to measure the penetration of the binder in a state of adhering to the particle surface.

When the hardness of the binder is excessively low, i.e., when the penetration is excessively high, adhesive force between the particles is increased, and flowability as a powder is decreased. Namely, as in the present invention, the penetration of the binder is 2 mm or less, preferably 1 mm or less. On the other hand, the above-described binder also functions as a lubricant during compaction, and thus when the hardness of the lubricant is excessively high, i.e., when the penetration is excessively low, lubricity tends to decrease. Therefore, the penetration of the binder is preferably 0.05 mm or more. In order to achieve particularly good lubricity, the penetration is preferably 0.3 mm or more.

Methods for adhering the alloy component with the binder include a method of adhering by heat-melting the binder, and a method of dissolving the binder in a solvent, mixing the resultant solution, and then evaporating the solvent. However, in order to localize the binder on the surface of the iron powder, the former method is preferred.

In order to decrease adhesive force between the iron powder and the iron powder, it is also effective to partially coat the iron powder with the binder and then add an iron powder not coated with the binder. As a result, the probability of contact between the binder and the binder can be decreased. In this case, the coverage with the binder is an average value of coverage of the iron powder including the iron powder not having the binder.

(Iron Powder)

The iron-based powder may contain Cu, C, Ni, Mo, and the like as alloy components. A method for adding the alloy components to the iron-based powder includes alloying the iron powder, preparing alloy component particles separately from the iron powder, or adhering the alloy components to the iron powder. As the iron powder, an atomized iron powder, a reduced iron powder, an iron powder to which an alloy component is adhered, or the like may be used. The iron powder is described in detail below.

As the iron powder, there are various iron powders according to the production methods, but a water atomized iron powder and/or a reduced iron powder is preferably used in view of compactibility, characteristics of a compacted body, and characteristics of a sintered body. Such an iron powder has irregularity in particle surfaces, and the strength of a compacted body and sintered body is increased due to engagement of irregularity during powder compaction. The iron powder is not particularly limited as long as it fall within the aforesaid definition, i.e., either a pure iron powder or an alloy steel powder (including a partially alloyed steel powder and a hybrid alloyed steel powder). The pure iron powder contains 98% or more of iron and impurities as the balance. The alloy steel powder contains alloy components such as Mn, Cu, Mo, Cr, W, Ni, P, S, V, Si, and the like in a total of about 10% by mass or less. In addition, previous addition of an alloy composition to molten steel is referred to as "prealloying", bonding of particles containing alloy components to iron powder surfaces by diffusion is referred to as "partial alloying", and combination of prealloying and partial alloying is referred to as "hybrid alloying". The particle diameter of an iron powder is generally in a range of 60 to 100 μm in terms of average particle diameter (according to sieve analysis defined by Japan Powder Metallurgy Association standard JPMA P02-1992).

(Wettability-Improving Treatment with Wettability-Improving Agent)

Since the water atomized iron powder and the reduced iron powder have irregularity on the surfaces thereof, the binder tends to locally stay in the irregularity. As a technique for remedying such a nonuniform distribution of the binder and making the distribution more uniform, there is a wettability-improving treatment of improving wettability of iron powder surfaces with the binder. In the present invention, it is undesired to excessively remove localization of the binder, but the wettability-improving treatment for controlling the coverage with the binder and the distribution is not prohibited.

An effective method of treatment with a wettability-improving agent is a method of previously coating at least iron powder surfaces with a wettability-improving agent before the segregation-free treatment (heat-mixing of the binder, the iron powder, and other alloy components). As the wettability-improving agent, a silane coupling agent, an acethylene glycol surfactant, a polyhydric alcohol surfactant, and the like can be used.

(Flowability-Improving Particles)

The flowability-improving particles used in the present invention are composed of fine powder having the effect of improving flowability of the iron powder and contain 50 to 100% by mass of carbon black. Carbon black that may be used for toner and paint is used and preferably has a particle diameter in a range of 5 to 100 nm. Since carbon black is composed of carbon as a main component, there is no fear that it remains as harmful impurities after sintering. In addition, carbon black is amorphous and thus rapidly diffuses as compared with graphite powder, and it is expected to be easily solid-dissolved even by sintering at low temperature for a short time.

The coverage with the flowability-improving particles adhering to the surface of the binder is preferably 50% or more. When the coverage is 50% or more, adhesive force between the binder and the binder can be securely decreased. An upper limit of the coverage need not be provided, and the coverage of 100% has no problem. However, from the viewpoint of avoiding the possibility of increase in ejection force during compaction, the coverage may be limited to 90% or less.

Figure 2:
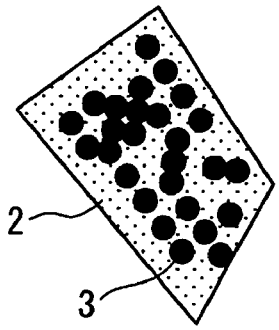
FIG. 2 is an enlarged explanatory view showing a coated portion shown in FIG. 1.

The coverage with the flowability-improving particles is represented by the ratio (%) of the total area of portions where the flowability-improving particles are present on the surfaces to the total area of portions coated with the binder within an SEM observation range. Namely, as shown in FIG. 2, the portion 2 coated with the binder which previously adheres to the surface of the iron powder (the same as in FIG. 1) has portions in the surface where the flowability-improving particles (in this example, carbon black 3) are present. The coverage of the binder-coated portion 2 with the flowability-improving particles is the area ratio (%) of portions 3 to the portion 2. For convenience sake, graphite is not shown in FIG. 2.

As a result of various investigations in the SEM observation, the inventors found that when the ratio of carbon black coating the surface of the binder adhering to the iron powder surface is determined, it is necessary that the acceleration voltage is 0.1 to 2 kV, and most clear contrast for discriminating among the iron powder, the binder, and carbon black is obtained within a range of 0.1 to 1 kV. As the detector used for the observation, an in-lens detector which produces a material-enhanced image is preferred rather than a secondary electron detector which produces a shape-enhanced image.

An image photographed under the optimized measurement conditions is input as digital data to a personal computer. The data is binarized with an image analysis software, and then the area ratio (%) of carbon black coating the surface of the binder is determined as a coverage with carbon black coating the surface of the binder. In the SEM observation for calculating the coverage, preferably about 20 fields of view are observed with a magnification of about 3000 times, and an average is determined.

When flowability-improving particles other than carbon black are added, preferably observation conditions suitable for each type of the flowability-improving particles are selected for determining the coverage by the same method. Instead of this, the coverage with the whole flowability-improving particles may be roughly estimated on the basis of the coverage with carbon black determined by the above-described observation and the ratio of carbon black in the flowability-improving particles.

Components added to the flowability-improving particles in addition to carbon black are roughly divided into the following two types:

(A) at least one of $Al_2O_3.MgO.2SiO_2.xH_2O$ (magnesium aluminosilicate), $SiO_2$, $TiO_2$, and $Fe_2O_3$; and (B) at least one of polymethyl methacrylate (PMMA) and polyethylene (PE).

When the components are added as the flowability-improving particles in addition to carbon black, the effect of improving flowability of the iron powder (particularly, the atomized iron powder) is further improved.

A metal oxide generally inhibits bonding between iron powder particles during sintering, thereby decreasing strength of a sintered body. Therefore, the amount of a metal oxide (for example, $Al_2O_3.MgO.2SiO_2.xH_2O$, $SiO_2$, $TiO_2$, $Fe_2O_3$, or the like) added as the flowability-improving particles is preferably decreased as much as possible. In addition, an organic material (for example, PMMA, PE, or the like) is expensive, and thus the amount of the organic material added is preferably decreased as much as possible. For this reason, the content of carbon black is within the range of 50 to 100% by mass.

It is generally known that if irregularity is present on surfaces of powder particles, the contact area between the particles is decreased, thereby decreasing adhesive force between the particles. Although the water atomized iron powder and reduced iron powder also have irregularity in the surfaces, the irregularity is not sufficient for decreasing adhesive force because the curvature is 0.1 to 50 $\mu m^{-1}$ and relatively small.

When the average particle diameter of the flowability-improving particles is less than 5 nm, the particles may be buried in irregularity of the surfaces of the iron powder and in the lubricant present on the surfaces of the iron powder. These fine particles are present as aggregates, but when the particles are excessively fine, the particles undesirably adhere as aggregates to the surfaces of the iron powder. In addition, the production cost of fine particles generally increases as the particle diameter decreases. On the other hand, when the average particle diameter exceeds 500 nm, the diameter is the same as the curvature of irregularity originally present in the surfaces of the iron powder, intended adhesion of the particles becomes meaningless. In particular, the flowability-improving particles of (A) are present in a sintered body without decomposition during sintering. The particles can be regarded as an inclusion in steel, and when the particles are excessively large, strength of a sintered body is decreased. For these reasons, the average particle diameter of the flowability-improving particles is preferably in the range of 5 to 500 nm, more preferably 100 nm or less. As the particle diameter of the flowability-improving particles, a value determined by arithmetic averaging in electron microscope observation is used for carbon black, a value determined by BET specific surface measurement on the assumption that the shape of the particles is spherical is used for (A), and a value measured by a microtrack method using ethanol as a dispersion medium is used for (B).

In addition, when the amount of the flowability-improving particles added is less than 0.01 parts by mass relative to 100 parts by mass of the iron powder, the stable flowability-improving effect is not achieved. On the other hand, when the amount exceeds 3 parts by mass, in compaction under the same pressure, the density of a green compact decreases, and consequently, strength of a sintered body undesirably decreases. Therefore, the amount of the flowability-improving particles added is preferably in a range of 0.01 to 3 parts by mass relative to 100 parts by mass of the iron powder. The amount is more preferably 0.05 parts by mass or more, and also preferably 0.2 parts by mass or less.

The effect of addition of the flowability-improving particles is that fine irregularity is provided in the surfaces of the iron powder to decrease the contact area between particles, thereby decreasing adhesive force. There is also the effect of inhibiting adhesion between the binder and the binder present on the surfaces of the iron powder.

(Addition of Iron Powder not Having Binder)

Considering the above-mentioned points, the iron powder not having the binder adhering thereto is considered to have excellent flowability.

As another embodiment of the present invention, there is an iron-based powder containing an iron powder not having the binder. This is based on the above-described viewpoint, and the iron powder contains less than 50% by mass of an iron powder not having the binder. When the amount of the iron powder not having the binder on the surfaces is 50% by mass or more, ejection force increases during compaction, and in some cases, die galling phenomenon may occur, and defects may occur in a compacted body. The amount of the iron powder not having the binder is more preferably 20% by mass or less. The amount is preferably 5% by mass or more from the viewpoint of achieving a significant effect, and more preferably 10% by mass or more.

The iron-based powder can be produced by mixing the iron powder subjected to the segregation-free treatment with the iron powder not subjected to the segregation-free treatment. The average particle diameter range of the iron powder preferred for addition is the same as the general iron powder. Further, the flowability-improving particles are first mixed with the iron powder not having the binder and then mixed with the iron powder after the segregation-free treatment, thereby further improving flowability. Although the reason for this is not elucidated, a supposed reason is that the flowability-improving particles further disperse on the surface of the binder due to the aggregation preventing effect that aggregates of the flowability-improving particles are ground by the iron powder without the binder. The same effect is expected when the iron powder not having the binder is replaced by another material powder not having the binder, but the iron powder is most preferred.

(Other)

The content of a composition (the one contained as an alloy steel powder and the one adhering with the binder) other than iron in the iron-based powder of the present invention is preferably 10 parts by mass or less relative to 100 parts by mass of iron powder. When the iron-based powder of the present invention is applied to powder metallurgy, additive powders (an alloying powder, a cutting ability improving powder, and the like) may be added and mixed for controlling the composition of a sintered body before filling in a die and compaction molding.

EXAMPLE

Invention Examples 1 to 9 and 16 (Tables 1 to 3): Stearic acid amide and ethylenebis(stearamide) as a binder, and an iron powder (300A manufactured by JFE Steel Corporation), a Cu powder, and a graphite powder as alloy components were heat-mixed with a Henschel-type high-speed mixer. Then, the resultant mixture was cooled to 60° C., and various flowability-improving particles and a free lubricant (i.e., zinc stearate) shown in Tables 1 and 2 were added and mixed. The physical properties of the flowability-improving particles were as shown in Table 4. The surface states of the resultant iron-based powders are shown in Table 3, and the penetration of the binder is shown in Table 1. The coverage of the binder surface with the flowability-improving particles was determined by (coverage of binder surface with carbon black)/(number ratio of carbon black particles in flowability-improving particles). The number ratio of particles was determined by correcting the weight ratio with the number of particles per weight which was roughly estimated from the average particle diameter and the specific gravity of the raw material.

A material represented by $Al_2O_3.MgO.2SiO_2.xH_2O$ is referred to as magnesium aluminosilicate, in which x may be any number as long as the complex compound shows stability but is usually considered to be about 1 to 2.

Invention Examples 12 and 17 to 20 (Tables 1 to 3): Iron-based powders were prepared by the same method as the above except that a binder and a free lubricant shown in Table 1 were used.

Figure 3:
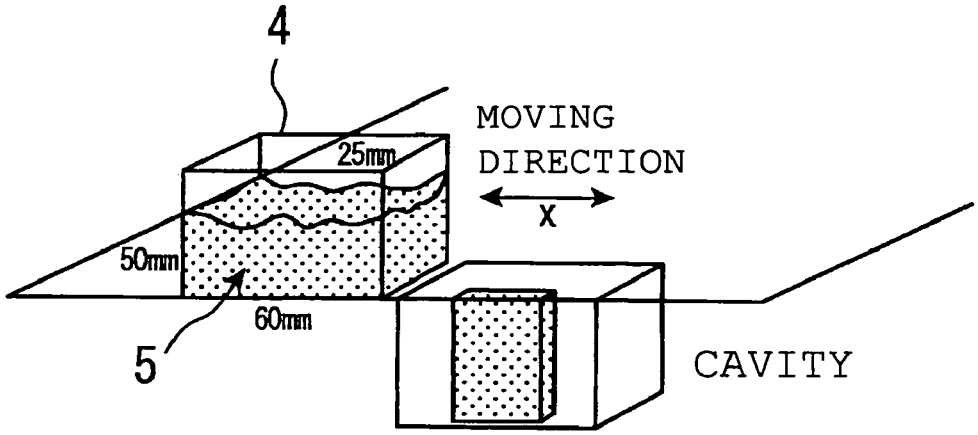
FIG. 3 is a perspective view schematically showing a principal portion of a filling tester.

The filling performance of each of the resultant iron-based powders was evaluated with a filling test machine shown in FIG. 3. In evaluation, a cavity provided in a vessel and having a length of 20 mm, a depth of 40 mm, and a width of 0.5 mm was filled with the iron-based powder. A filling shoe 4 (length 60 mm, width 25 mm, height 50 mm) filled with the iron-based powder 5 was moved in an arrow direction (moving direction) shown in FIG. 3 at a moving rate of 200 mm/sec and maintained on a cavity for a retention time of 0.5 seconds. The percentage of filling density (filling weight/cavity volume) after filling to the apparent density before filling is determined as the filling rate (filling rate of 100% represents complete filling). The same test was repeated 10 times, and filling variation was represented by a standard deviation of filling rates.

In addition, a mold was filled with each of the iron-based powders of these invention examples and compressed (com-- having a thickness of 10 mm. Further, sintering (sintering temperature 1130° C., sintering time 20 minutes) was performed in a RX gas atmosphere to prepare a tensile test specimen and a Charpy test specimen. The results of a tensile test and a Charpy test are also shown in Table 3. Invention Examples 1 to 9 and 12 show good degree of filling variation. Also, strength and toughness of sintered bodies are substantially the same value as an example not containing flowability-improving particles (Comparative Example 1 described below) and are good.

In Invention Example 16, the amount of the flowability-improving particles added is as low as 0.01%, and the coverage of the binder surface with the flowability-improving particles prepared under the above-described production conditions is excessively small. Therefore, filling variation is larger than in the above-mentioned invention examples.

Invention Examples 17 and 18 are examples showing a binder coverage of over 50%. In this case, filling variation is larger than in the other invention examples.

Invention Examples 19 and 20 are examples showing a binder penetration out of the optimum range (0.05 to 1 mm) or the preferred range (0.05 to 2 mm). In this case, filling variation is larger than in the other invention examples.

Invention Examples 10, 11, 13, 14, and 15 (Tables 1 to 3): Stearic acid amide and ethylenebis(stearamide) as a binder, and an iron powder (an amount smaller than that shown in Table 1 by 5% by mass, i.e., 92.4% by mass), a Cu powder, and a graphite powder shown in Tables 1 and 2 were heat-mixed with a Henschel-type high-speed mixer. Then, the resultant mixture was cooled to 60° C., and an iron powder (corresponding to 5% by mass) not having a binder adhering thereto, flowability-improving particles and a free lubricant shown in Tables 1 and 2 were added and mixed. The resultant iron-based powders were examined by the same method as in Invention Examples 1 to 9, etc.

Invention Examples 10 to 15 (excluding 12) show good filling performance, but when the coverage with the binder is 10% or more, the filling performance is more excellent. In addition, the resultant sintered bodies have good characteristics, but when the coverage with the binder is 30% or more, sintered bodies have excellent characteristics.

In the invention examples, the compaction densities of compacted bodies are 6.9 to 7.1 $Mg/m^3$ in compaction at 686 MPa, and the ejection force is 10 to 15 MPa. Any one of these values is in a problem-free range.

On the other hand, as a comparative example, stearic acid amide and ethylenebis(stearamide) as a binder, and an iron powder, a Cu powder, and a graphite powder as alloy components were heat-mixed with a Henschel-type high-speed mixer. Then, the resultant mixture was cooled to 60° C., and a free lubricant (i.e., zinc stearate) was added and mixed. In this example, the flowability-improving particles were not used. This example corresponds to Comparative Example 1 shown in Tables 1 to 3. In Comparative Example 1, a sintered body has good characteristics, but filling performance significantly deteriorates.

In addition, an iron-based powder was prepared by the same method as in Invention Examples 1 to 9, etc. except that $SiO_2$ containing 25% by mass of carbon black was added and mixed as flowability-improving particles. This example corresponds to Comparative Example 2 shown in Tables 1 to 3. Table 4 shows the physical properties of flowability-improving particles used in combination with carbon black. In Comparative Example 2, filling performance is good, but strength of a sintered body significantly decreases.

In each of the comparative examples, a filling test, a tensile test, and a Charpy test conducted were the same as in the invention examples, and thus description thereof is omitted.

TABLE 1

| | Mixing ratio of alloy component (% by mass)*1 | | | Amount of binder added (parts by mass)*2 | | | | Penetration | Amount of free lubricant added (parts by mass)*2 | | |
|---|---|---|---|---|---|---|---|---|---|---|---|
| | Iron powder (300 A) | Cu powder | Graphite powder | Stearic acid amide | Ethylene-bis (stearamide) | Zinc stearate | PE | of binder (mm) | Ethylene-bis (stearamide) | Stearic acid amide | Zinc stearate |
| Invention Example 1 | 97.4 | 2 | 0.6 | 0.3 | 0.3 | — | — | 0.8 | — | — | 0.2 |
| Invention Example 2 | 97.4 | 2 | 0.6 | 0.3 | 0.3 | — | — | 0.8 | — | — | 0.2 |
| Invention Example 3 | 97.4 | 2 | 0.6 | 0.3 | 0.3 | — | — | 0.8 | — | — | 0.2 |
| Invention Example 4 | 97.4 | 2 | 0.6 | 0.3 | 0.3 | — | — | 0.8 | — | — | 0.2 |
| Invention Example 5 | 97.4 | 2 | 0.6 | 0.3 | 0.3 | — | — | 0.8 | — | — | 0.2 |
| Invention Example 6 | 97.4 | 2 | 0.6 | 0.3 | 0.3 | — | — | 0.8 | — | — | 0.2 |
| Invention Example 7 | 97.4 | 2 | 0.6 | 0.3 | 0.3 | — | — | 0.8 | — | — | 0.2 |
| Invention Example 8 | 97.4 | 2 | 0.6 | 0.3 | 0.3 | — | — | 0.8 | — | — | 0.2 |
| Invention Example 9 | 97.4 | 2 | 0.6 | 0.3 | 0.3 | — | — | 0.8 | — | — | 0.2 |
| Invention Example 10 | 97.4 | 2 | 0.6 | 0.2 | 0.2 | — | — | 0.8 | 0.1 | 0.1 | 0.2 |
| Invention Example 11 | 97.4 | 2 | 0.6 | 0.2 | 0.2 | — | — | 0.8 | 0.15 | 0.15 | 0.1 |
| Invention Example 12 | 97.4 | 2 | 0.6 | — | — | 0.4 | — | 0.5 | — | — | 0.4 |
| Invention Example 13 | 97.4 | 2 | 0.6 | 0.3 | 0.3 | — | — | 0.8 | — | — | 0.2 |
| Invention Example 14 | 97.4 | 2 | 0.6 | 0.3 | 0.3 | — | — | 0.8 | — | — | 0.2 |
| Invention Example 15*5 | 97.4 | 2 | 0.6 | 0.04 | 0.04 | — | — | 0.8 | — | — | 0.72 |
| Invention Example 16*6 | 97.4 | 2 | 0.6 | 0.3 | 0.3 | — | — | 0.8 | — | — | 0.2 |
| Invention Example 17*5 | 97.4 | 2 | 0.6 | — | — | 0.6 | — | 0.8 | — | — | 0.2 |
| Invention Example 18*5 | 97.4 | 2 | 0.6 | — | 0.6 | — | 0.2 | 0.5 | — | — | 0.2 |
| Invention Example 19*7 | 97.4 | 2 | 0.6 | — | — | — | 0.6 | 1.3 | — | — | 0.2 |
| Invention Example 20*8 | 97.4 | 2 | 0.6 | — | — | — | 0.6 | 2.5 | — | — | 0.2 |
| Comparative Example 1 | 97.4 | 2 | 0.6 | 0.3 | 0.3 | — | — | 0.8 | — | — | 0.2 |
| Comparative Example 2 | 97.4 | 2 | 0.6 | 0.3 | 0.3 | — | — | 0.8 | — | — | 0.2 |

*1Percentage in alloy components

*2Ratio to 100 parts by mass of iron powder

*3Percentage in flowability-improving particles

*4$Al_2O_3 \cdot MgO \cdot 2SiO_2 \cdot xH_2O$

*5Example in which the coverage with the binder was out of the preferred range.

*6Example in which the coverage of the binder surface with the flowability-improving particles was out of the preferred range.

*7Example in which the penetration of the binder was out of the optimum range.

*8Example in which the penetration of the binder was out of the preferred range.

TABLE 2

| | Adding amount in flowability-improving particles (parts by mass)*2 | | | | | | | | Content of carbon black in flowability-improving particles (% by mass)*3 |
|---|---|---|---|---|---|---|---|---|---|
| | Carbon black | Magnesium alumino-silicate*4 | $SiO_2$ | $TiO_2$ | $Fe_2O_3$ | $CaCO_3$ | PMMA | PE | |
| Invention Example 1 | 0.1 | 0.1 | — | — | — | — | — | — | 50 |
| Invention Example 2 | 0.1 | — | 0.05 | — | — | — | — | — | 67 |
| Invention | 0.1 | — | — | 0.1 | — | — | — | — | 50 |

TABLE 2-continued

| | Adding amount in flowability-improving particles (parts by mass)*2 | | | | | | | | Content of carbon black in flowability-improving particles (% by mass)*3 |
|---|---|---|---|---|---|---|---|---|---|
| | Carbon black | Magnesium alumino-silicate*4 | $SiO_2$ | $TiO_2$ | $Fe_2O_3$ | $CaCO_3$ | PMMA | PE | |
| Example 3 Invention | 0.1 | — | — | — | 0.05 | — | — | — | 67 |
| Example 4 Invention | 0.1 | — | — | — | — | 0.1 | — | — | 50 |
| Example 5 Invention | 0.15 | — | — | — | — | — | 0.05 | — | 75 |
| Example 6 Invention | 0.15 | — | — | — | — | — | — | 0.05 | 75 |
| Example 7 Invention | 0.2 | — | — | — | — | — | — | — | 100 |
| Example 8 Invention | 0.1 | — | — | — | — | — | — | — | 100 |
| Example 9 Invention | 0.1 | 0.1 | — | — | — | — | — | — | 50 |
| Example 10 Invention | 0.15 | — | 0.05 | — | — | — | — | — | 75 |
| Example 11 Invention | 0.15 | — | — | 0.05 | — | — | — | — | 75 |
| Example 12 Invention | 0.05 | — | — | — | — | — | — | — | 100 |
| Example 13 Invention | 0.03 | — | — | — | — | — | — | — | 100 |
| Example 14 Invention | 0.03 | — | — | — | — | — | — | — | 100 |
| Example 15*5 Invention | 0.005 | 0.005 | — | — | — | — | — | — | 50 |
| Example 16*6 Invention | 0.1 | — | — | — | — | — | — | — | 100 |
| Example 17*5 Invention | 0.1 | — | — | — | — | — | — | — | 100 |
| Example 18*5 Invention | 0.1 | — | — | — | — | — | — | — | 100 |
| Example 19*7 Invention | 0.1 | — | — | — | — | — | — | — | 100 |
| Example 20*8 Comparative | — | — | — | — | — | — | — | — | — |
| Example 1 Comparative | 0.05 | — | 0.15 | — | — | — | — | — | 25 |
| Example 2 | | | | | | | | | |

*1Percentage in alloy components
*2Ratio to 100 parts by mass of iron powder
*3Percentage in flowability-improving particles
*4$Al_2O_3 \cdot MgO \cdot 2SiO_2 \cdot xH_2O$
*5Example in which the coverage with the binder was out of the preferred range.
*6Example in which the coverage of the binder surface with the flowability-improving particles was out of the preferred range.
*7Example in which the penetration of the binder was out of the optimum range.
*8Example in which the penetration of the binder was out of the preferred range.

TABLE 3

| | Surface state of iron powder | | | Sintered body | |
|---|---|---|---|---|---|
| | Coverage with binder (%) | Coverage of binder surface with flowability-improving particles (%) | Filling variation (%) | Tensile strength (MPa) | Charpy impact value ($J/cm^3$) |
| Invention Example 1 | 39 | 80 | 2 | 435 | 14.5 |
| Invention Example 2 | 46 | 70 | 1 | 440 | 14.7 |
| Invention Example 3 | 35 | 78 | 3 | 450 | 15.2 |

TABLE 3-continued

| | Surface state of iron powder | | | Sintered body | |
|---|---|---|---|---|---|
| | Coverage with binder (%) | Coverage of binder surface with flowability-improving particles (%) | Filling variation (%) | Tensile strength (MPa) | Charpy impact value ($J/cm^3$) |
| Invention Example 4 | 40 | 68 | 2 | 445 | 14.5 |
| Invention Example 5 | 31 | 82 | 3 | 435 | 14.6 |

TABLE 3-continued

| | Surface state of iron powder | | | Sintered body | |
|---|---|---|---|---|---|
| | Coverage of binder | | | | |
| | Coverage with binder (%) | surface with flowability-improving particles (%) | Filling variation (%) | Tensile strength (MPa) | Charpy impact value (J/cm$^3$) |
| Invention Example 6 | 37 | 68 | 2 | 447 | 14.8 |
| Invention Example 7 | 33 | 55 | 2 | 448 | 14.9 |
| Invention Example 8 | 36 | 84 | 2 | 462 | 15.3 |
| Invention Example 9 | 35 | 62 | 3 | 455 | 15.0 |
| Invention Example 10 | 39 | 78 | 3 | 437 | 14.6 |
| Invention Example 11 | 33 | 84 | 2 | 452 | 15.3 |
| Invention Example 12 | 46 | 82 | 3 | 455 | 15.2 |
| Invention Example 13 | 20 | 87 | 3 | 453 | 13.8 |
| Invention Example 14 | 12 | 90 | 3 | 440 | 14.0 |
| Invention Example 15*5 | 8 | 90 | 4 | 450 | 14.2 |
| Invention Example 16*6 | 37 | 30 | 8 | 445 | 14.5 |
| Invention Example 17*5 | 56 | 70 | 5 | 445 | 14.0 |
| Invention Example 18*5 | 54 | 55 | 5 | 420 | 10.8 |

TABLE 3-continued

| | Surface state of iron powder | | | Sintered body | |
|---|---|---|---|---|---|
| | Coverage of binder | | | | |
| | Coverage with binder (%) | surface with flowability-improving particles (%) | Filling variation (%) | Tensile strength (MPa) | Charpy impact value (J/cm$^3$) |
| Invention Example 19*7 | 48 | 48 | 5 | 438 | 13.8 |
| Invention Example 20*8 | 54 | 30 | 10 | 425 | 13.3 |
| Comparative Example 1 | 42 | 0 | 12 | 446 | 14.9 |
| Comparative Example 2 | 48 | 70 | 2 | 424 | 11.2 |
| Invention Example 17*5 | 56 | 70 | 5 | 445 | 14.0 |
| Invention Example 18*5 | 54 | 55 | 5 | 420 | 10.8 |
| Invention Example 19*7 | 48 | 48 | 5 | 438 | 13.8 |
| Invention Example 20*8 | 54 | 30 | 10 | 425 | 13.3 |

*1Percentage in alloy components
*2Ratio to 100 parts by mass of iron powder
*3Percentage in flowability-improving particles
*4$Al_2O_3 \cdot MgO \cdot 2SiO_2 \cdot xH_2O$
*5Example in which the coverage with the binder was out of the preferred range.
*6Example in which the coverage of the binder surface with the flowability-improving particles was out of the preferred range.
*7Example in which the penetration of the binder was out of the optimum range.
*8Example in which the penetration of the binder was out of the preferred range.

TABLE 4

| Flowability-improving particles | | Density (Mg/m$^3$) | Apparent density (Mg/m$^3$) | Specific surface (m$^2$/g) | Average particle diameter (μm) | Single particle diameter (nm) |
|---|---|---|---|---|---|---|
| $TiO_2$ | Manufactured by Ishihara Sangyo Kaisha, Ltd. A-100 | 3.7~3.9 | | 237.2 | 0.2 | |
| $SiO_2$ | Manufactured by Cabot Specialty Chemicals, Inc. CAB-O-SIL EH-5 | 2.2 | 0.016 | 299.1 | 0.2~0.3 | |
| $Fe_2O_3$ | Manufactured by JFE Steel Corporation | | 0.53 | 16.2 | 0.44 | 80 |
| $Al_2O_3 \cdot MgO \cdot 2SiO_2 \cdot xH_2O$ | Manufactured by Fuji Kagaku Corp. Neusilin UFL-II | 2 | 0.077 | 294.6 | 1.6 | 20 |
| PMMA | Manufactured by Zeon Kasei Co., Ltd. F325 | 1 | 0.4 | 18.5 | 25 | 500 |
| PE | | 1 | | | 5 | 500 |

Table 1 indicates that any one of the invention examples shows good filling performance and good tensile strength and Charpy impact value. In particular, in the invention examples in which the coverage with the binder, penetration of the binder, and the coverage of the binder surface with the flowability-improving particles are in proper ranges, each of the above-described characteristics is very excellent.

On the other hand, Comparative Example 1 shows large filling variation, and Comparative Example 2 shows low tensile strength and low Charpy impact value.

Even when the type of the iron powder (reduced iron powder, alloy steel powder, or the like), the additive powder (alloying powder, cutting ability-improving powder, or the like), and the lubricant were different from those shown in Table 1 (for example, a Ni powder, a MnS powder, a $CaF_2$ powder, lithium stearate, and the like), the same tendency as in Example 1 was observed, and the advantage of the present invention was confirmed.

INDUSTRIAL APPLICABILITY

According to the present invention, an iron-based powder containing an iron powder as a material, having excellent flowability, and being suitable for use in powder metallurgy can be provided.

The invention claimed is:

1. An iron-based powder for powder metallurgy comprising iron powder particles with surfaces to which flowability-improving particles adhere through a binder having penetration of 0.05 or more and 2 mm or less, wherein the flowability-improving particles contain 50 to 100% by mass of carbon black powder based on the flowability-improving particles, and wherein coverage of the iron power with the binder is 10% or more and 50% or less and coverage of the binder with the flowability-improving particles is 50% or more.

2. The iron-based powder for powder metallurgy according to claim 1, wherein the binder is at least one of zinc stearate, lithium stearate, calcium stearate, stearic acid monoamide, and ethylenebis(stearamide).

3. The iron-based powder for powder metallurgy according to claim 1, wherein the iron-based powder contains as an alloy component at least one selected from Cu, C, Ni, and Mo.

4. The iron-based powder for powder metallurgy according to claim 1, wherein the iron powder is at least one selected from an atomized iron powder, a reduced iron powder, and an iron powder to which an alloy component is partially diffusion bonded.

5. The iron-based powder for powder metallurgy according to claim 1, wherein the iron powder contains less than 50% by mass of an iron powder not having the binder on the surfaces thereof.

6. The iron-based powder for powder metallurgy according to claim 1, wherein the flowability-improving particles contain, in addition to the carbon black, at least one of powders of $Al_2O_3.MgO.2SiO_2.xH_2O$, $SiO_2$, $TiO_2$, and $Fe_2O_3$, and the average particle diameter of the flowability-improving particles is in a range of 5 to 500 nm.

7. The iron-based powder for powder metallurgy according to claim 1, wherein the flowability-improving particles are mixed at a ratio of 0.01 to 0.3 parts by mass relative to 100 parts by mass of the iron powder.

8. The iron-based powder for powder metallurgy according to claim 1, wherein the flowability-improving particles contain, in addition to the carbon black, a PMMA powder and/or a PE powder, and the average particle diameter of the flowability-improving particles is in a range of 5 to 500 nm.

9. A method of improving flowability of the iron-based powder for powder metallurgy comprising adhering, to surfaces of iron powder particles, flowability-improving particles containing 50 to 100% by mass of carbon black powder based on the flowability-improving particles through a binder having penetration in a range of 0.05 to 2 mm, so that coverage of the iron powder with the binder is 10% or more and 50% or less and coverage of the binder with the flowability-improving particles is 50% or more.

10. The method according to claim 1, wherein the flowability-improving particles contain, in addition to the carbon black, at least one of powders of $Al_2O_3.MgO.2SiO_2.xH_2O$, $SiO_2$, $TiO_2$, and $Fe_2O_3$, and the average particle diameter of the flowability-improving particles is in a range of 5 to 500 nm.

11. The method according to claim 1, wherein the flowability-improving particles are mixed at a ratio of 0.01 to 0.3 parts by mass relative to 100 parts by mass of the iron powder.

12. The method according to claim 1, wherein the flowability-improving particles contain, in addition to the carbon black, a PMMA powder and/or a PE powder, and the average particle diameter of the flowability-improving particles is in a range of 5 to 500 nm.

* * * * *